US010722907B2

(12) United States Patent
Xu et al.

(10) Patent No.: US 10,722,907 B2
(45) Date of Patent: Jul. 28, 2020

(54) SPLASH WATER OUTLET MECHANISM

(71) Applicant: XIAMEN SOLEX HIGH-TECH INDUSTRIES CO., LTD., Xiamen, Fujian (CN)

(72) Inventors: Wencong Xu, Fujian (CN); Zhaoxing Lan, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 207 days.

(21) Appl. No.: 15/395,369

(22) Filed: Dec. 30, 2016

(65) Prior Publication Data

US 2018/0043377 A1 Feb. 15, 2018

(30) Foreign Application Priority Data

Aug. 11, 2016 (CN) ..... 2016 1 0656601

(51) Int. Cl.
*B05B 1/34* (2006.01)
*B05B 1/26* (2006.01)
*B05B 1/18* (2006.01)

(52) U.S. Cl.
CPC ..... *B05B 1/3426* (2013.01); *B05B 1/185* (2013.01); *B05B 1/26* (2013.01); *B05B 1/3405* (2013.01)

(58) Field of Classification Search
CPC ..... B05B 1/3426; B05B 1/185; B05B 1/26; B05B 1/3405; B05B 1/08; B05B 1/02; B05B 1/083; B05B 1/34; B05B 3/14; F15C 1/22
USPC ..... 239/589–601
See application file for complete search history.

(56) References Cited

U.S. PATENT DOCUMENTS

| | | | | |
|---|---|---|---|---|
| 3,563,462 | A | 2/1971 | Bauer | |
| 2011/0233301 | A1* | 9/2011 | Gopalan | B05B 1/08 239/101 |
| 2013/0240644 | A1* | 9/2013 | Zhou | B05B 1/08 239/589.1 |

* cited by examiner

*Primary Examiner* — Chee-Chong Lee
*Assistant Examiner* — Juan C Barrera
(74) *Attorney, Agent, or Firm* — Cooper Legal Group, LLC

(57) ABSTRACT

A water outlet mechanism, includes at least two diversion waterway sets connected to the water source and an outlet, each diversion waterway set has at least two diversion waterways and at least two water diversion passages; water from the at least two diversion waterways impact and converge and then enter the water diversion passages, the flowing direction of the at least two water diversion passages intersect, and water from the at least two water diversion passages impact and then spray out of the outlet. Water from at least two diversion waterways impacts and converges and then enters the water diversion passage, the water particles are refined and shaken; the direction of the at least two water diversion passages intersect, and water in the cavity of the inlet impact again to form wavy water type and then sprays out of the outlet.

12 Claims, 7 Drawing Sheets

SPLASH WATER OUTLET MECHANISM

FIELD OF THE INVENTION

The present invention relates to a splash water outlet mechanism.

BACKGROUND OF THE INVENTION

Existing outlet mechanism, as disclosed in American patent database with publishing number U.S. Pat. No. 3,563,462, comprises two first waterways, each waterway is disposed with a second waterways; the outlet water of the two first waterway converges to form a third waterway; water in the two second waterways and the third waterway converges and drains out of the outlet. A portion of water doesn't go through two impacts, the refining effect of water particles is bad, the water particles are still large. The existing outlet mechanism needs further improvement.

SUMMARY OF THE INVENTION

The present invention is provided with a splash water outlet mechanism, which overcomes the disadvantages of the traditional technology.

The technical solution of the present invention is that:

A splash water outlet mechanism, comprising at least two diversion waterway sets (12) connected to the water source (10) and an outlet (14), each diversion waterway set (12) comprises at least two diversion waterways (16, 18), wherein further comprising at least two water diversion passages (20, 22); water of the at least two diversion waterways (16, 18) impact and converge to the water diversion passages (20, 22), the flowing direction of the at least two water diversion passages (20, 22) intersect, water impacts and sprays out of the outlet (14).

In another preferred embodiment, the outlet openings of the at least two diversion waterways (16, 18) face to each other.

In another preferred embodiment, it further comprises an inlet waterway (24) connected to the water source (10), each diversion waterway set (12) comprises at least a first diversion waterway (16) and a second diversion waterway (18), the inlet waterway (24) is connected to the second diversion waterways (18) of the diversion waterway sets (12), the inlet waterway (24) and the second diversion waterways (18) are arranged in L shape.

In another preferred embodiment, the first diversion waterway (16) of the diversion waterway sets (12) comprises a longitudinal portion connected to the water source (10) and a lateral portion connected to the longitudinal portion, the lateral portion is faced to and connected to the second diversion waterway (18).

In another preferred embodiment, the second diversion waterways (18) are arranged in a smooth curve.

In another preferred embodiment, the connecting portion of the inlet waterway (24) and the second diversion waterway (18) is smooth transition.

In another preferred embodiment, the diversion waterway sets (12) are corresponding to water diversion passages (20, 22) one by one; the entrance of the converge portion of the at least two diversion waterways (16, 18) faced to the water diversion passages (20, 22) is concaved.

In another preferred embodiment, two water diversion passages (20, 22) of the at least two water diversion passages (20, 22) are axially symmetrically arranged, the outlet opening of the two water diversion passages are faced to each other, the flowing direction of the outlet opening of the two water diversion passages intersect.

In another preferred embodiment, two water diversion passages (20, 22) are arranged smoothly, and the two diversion passages (20, 22) form a splayed structure with the openings faced upwardly.

In another preferred embodiment, it comprises a diverter shell (26) and a diverter (28), the diverter shell (26) is hollow throughout, the diverter (28) is fixedly assembled in the diverter shell (26), the diverter (28) is disposed with above mentioned outlet (14), the inlet waterway (24), the second diversion waterways (18), the lateral portions and the water diversion passages (20, 22); the entrance of the lateral portion is disposed at the outer wall of the diverter (28), a gap or notch is disposed between the inner wall of the diverter shell (26) and the outer wall of the diverter (28), the gap or the notch forms above mentioned longitudinal portion.

In another preferred embodiment, the portion of the diverter (28) faced to the inlet waterway (24) is concaved with a concave portion.

In another preferred embodiment, the diverter (28) comprises a main body portion (30) and a coupling portion (32), a first coupling surface of the main body portion (30) is concaved with above mentioned outlet (14), the inlet waterway (24), the second diversion waterway (18), the lateral portion and a groove portion (34) of the water diversion passages (20, 22), a second coupling surface of the coupling portion (32) is fixedly connected to the first coupling surface of the main body portion (30) in sealing way, the sealing connection makes the groove portion (34) form above mentioned outlet (14), the inlet waterway (24), the second diversion waterway (18), the lateral portion and the water diversion passages (20, 22).

In another preferred embodiment, the diverter (28) comprises a base (36) and an accessory portion (38), the base (36) is disposed with a first coupling surface, the lower portion of the first coupling surface is protruding with a protruding portion, the top surface of the protruding portion is concaved with a first groove, the first groove is connected to the bottom surface of the protruding portion, the lower portion of the first groove forms above mentioned outlet (14); the accessory portion (38) is disposed with a second coupling surface, the second coupling surface is concaved with a second groove; the accessory portion (38) is fixedly connected to the base (36), the accessory portion (38) is disposed above the protruding portion of the base (36), the second coupling surface of the accessory portion (38) is coupled to the first coupling surface of the base (36), and the second groove forms above mentioned inlet waterway (24) and the second diversion waterway (18), the accessory portion (38) and the protruding portion are arranged with space to form above mentioned lateral portion, the accessory portion (38) and the groove wall of the first groove are arranged with space to form above mentioned water diversion passages (20, 22).

Compared to the traditional technology, the technical solution of the present invention has following advantages:

Water from at least two diversion waterways impact and converge and then enter the water diversion passage, the water particles are refined and shaken, the refining effect is well; the direction of the at least two water diversion passages intersect, and water in the cavity of the inlet impact again to form wavy water type and then sprays out of the outlet, forming oscillating splash water. By controlling the intersecting direction of the flowing, the device can form intersecting water beams at the intersection surface, and enlarge the width of the intersecting water beams.

The at least two diversion waterways have the outlet opening face to face, the water particles are refined better.

The entrance of the converge portion of the at least two diversion waterways faced to the water diversion passages is concaved, swirl water forms in the concave portion, thus generating turbulent and oscillating flowing.

The two water diversion passages are arranged smoothly, and the two water diversion passages form a splayed structure with the opening faced upwardly, thus increasing the swirl effect and the oscillating effect, thus forming oscillating splash water.

BRIEF DESCRIPTION OF THE DRAWINGS

The present invention will be further described with the drawings and the embodiments.

DETAILED DESCRIPTION OF THE EMBODIMENTS

Embodiment 1

Figure 1:
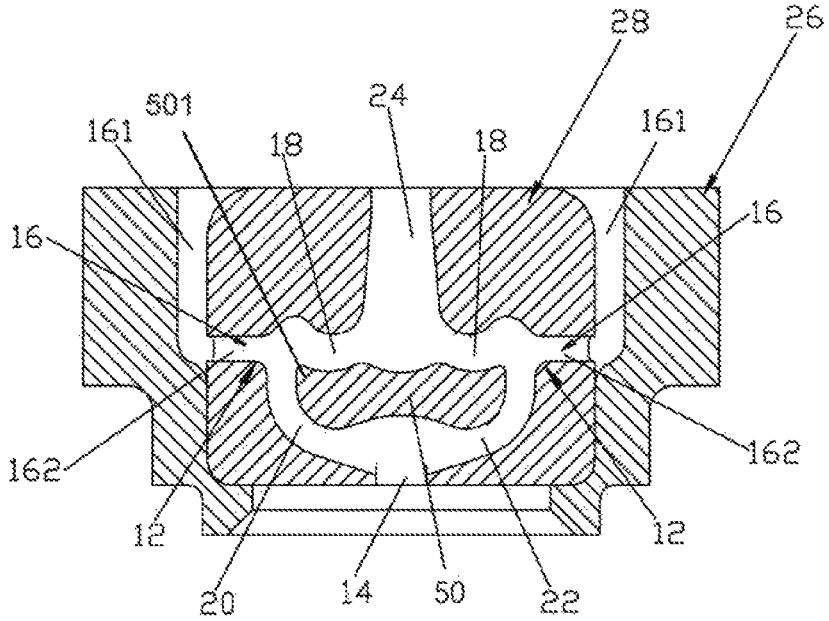
FIG. 1 illustrates a sectional diagram of a splash water outlet mechanism of a first embodiment.
Figure 2:
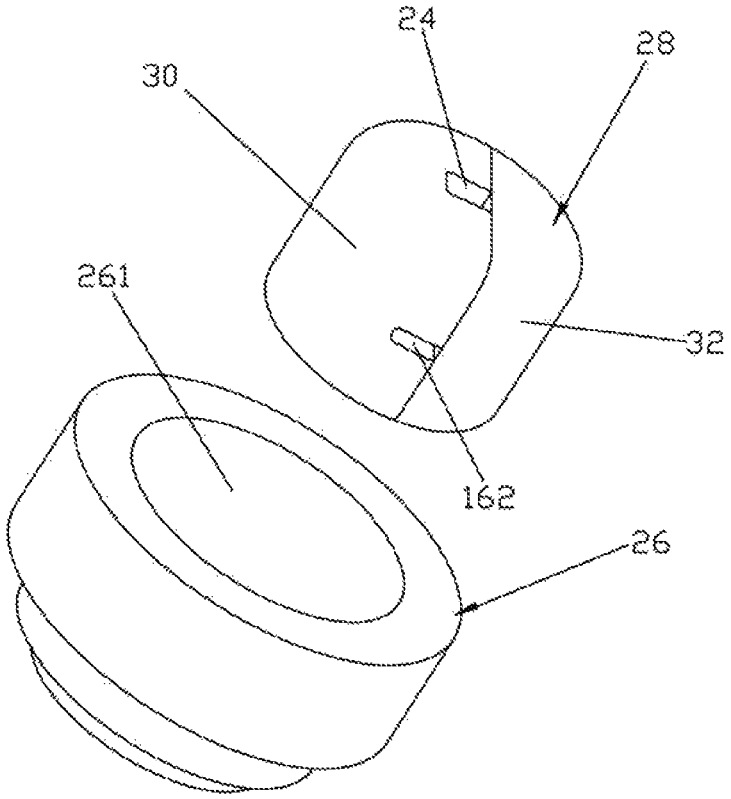
FIG. 2 illustrates an exploded and schematic diagram of the splash water outlet mechanism of the first embodiment.
Figure 3:
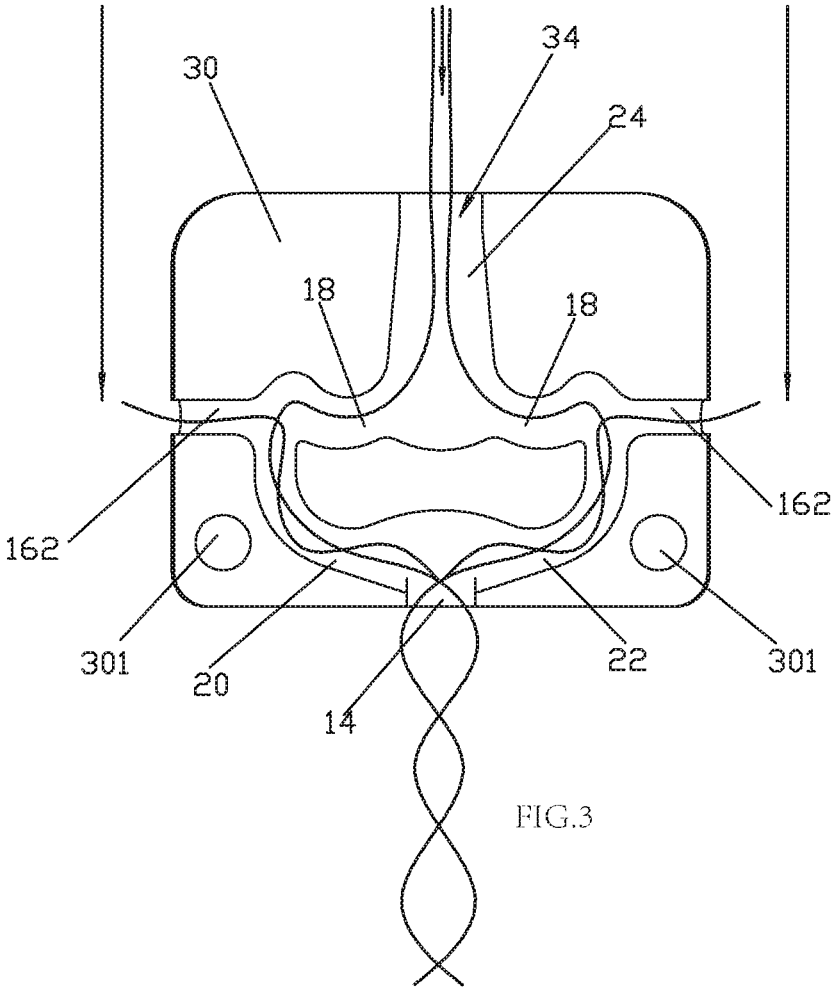
FIG. 3 illustrates a front view of a main body portion of the first embodiment.
Figure 4:
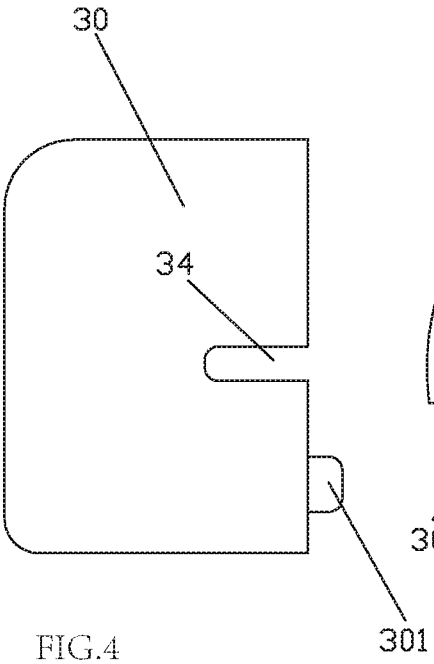
FIG. 4 illustrates a left view of the main body portion of the first embodiment.
Figure 5:
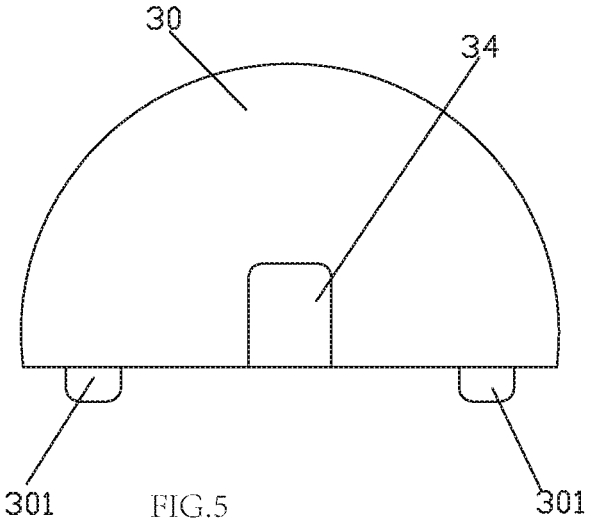
FIG. 5 illustrates a top view of the main body portion of the first embodiment.
Figure 6:
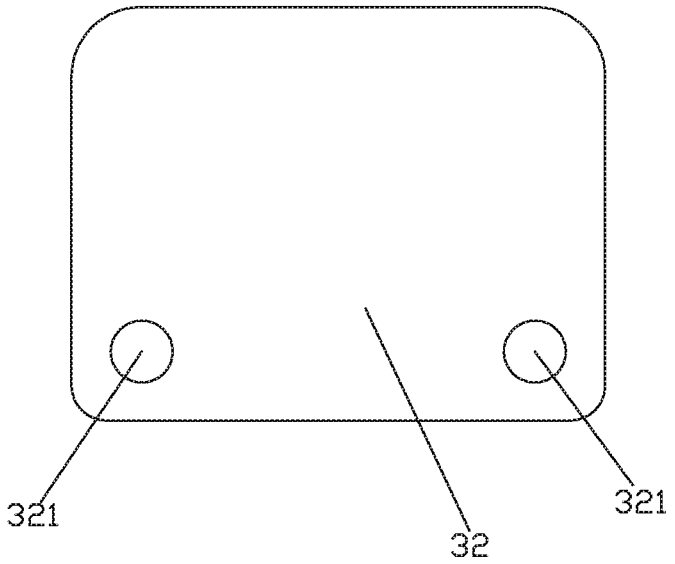
FIG. 6 illustrates a back view of a coupling portion of the first embodiment.
Figure 7:
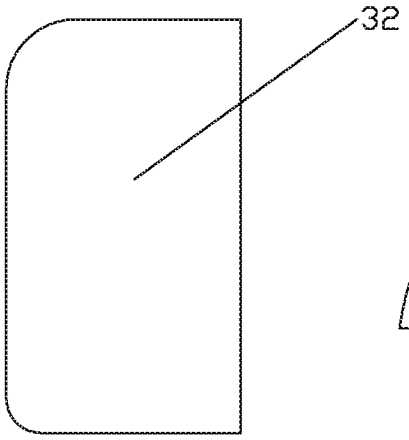
FIG. 7 illustrates a right view of the coupling portion of the first embodiment.
Figure 8:
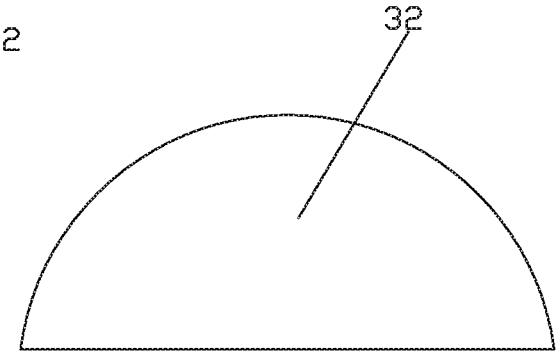
FIG. 8 illustrates a top view of the coupling portion of the first embodiment.

Please referring to FIGS. 1-8, a splash water outlet mechanism comprises two diversion waterway sets 12 connected to the water source 10, an outlet 14 and two water diversion passages 20, 22; each diversion waterway set 12 comprises two diversion waterways, one of them is first diversion waterway 16, the other is second diversion waterway 18, the two diversion waterway sets 12 are corresponding to the two water diversion passages 20, 22 one by one; the exits of the two diversion waterways 16, 18 are faced to each other, water of the two diversion waterways 16, 18 impact and converge to the water diversion passages 20, 22, the flowing direction of the two water diversion passages 20, 22 intersect, water impacts and sprays out of the outlet 14. The water flowing area of the water diversion passage is smaller than the sum of flowing area of the first diversion waterway 16 and the second diversion waterway 18, or smaller than the flowing area of the second diversion waterway 18.

In detail, the outlet mechanism further comprises an inlet waterway 24 connected to the water source 10, the inlet waterway 24 is connected to the second diversion waterways 18 of the diversion waterway sets 12, the inlet waterway 24 and the second diversion waterways 18 are arranged in L shape, making water from the inlet waterway 24 firstly impact the mechanism and then turn to the second diversion waterways 18. The impact with the mechanism refines the water particles. The first diversion waterway 16 comprises a longitudinal portion 161 connected to the water source 10 and a lateral portion 162 connected to the longitudinal portion 161, the second diversion waterways 18 are arranged laterally, making the lateral portion 162 and the second diversion waterways 18 connected face to face, water flowing from the longitudinal portion 161 to the lateral portion 162 needs to change its direction. During changing of the direction, collision happens to refine the water particles. The second diversion waterways are arranged in a smooth curve laterally. An obstacle 50 is defined by the second diversion waterways 18 of the at least two diversion waterways and the at least two water diversion passages 20 and 22, and in a cross-sectional view, a surface of the obstacle 50 facing an inlet waterway 24 through which the second diversion waterways 18 are connected to the water source is concave. A lowest position 501 of an outlet of the lateral portion of each of the second diversion waterways 18 protrudes upward, that is, the two ends of the obstacle 50 protrude upward.

In detailed, the connecting portion of the inlet waterway 24 and the second diversion waterway 18 is smooth transition for example in arc shaped, the portion of the diverter 28 faced to the inlet waterway 24 is disposed with a concave portion, making water flowing from the inlet waterway to the second diversion waterway rotate in swirl shape, forming turbulent flowing; the second diversion waterways 18 are arranged in a smooth curve laterally, further improving the turbulent flowing and enhancing the swirl; the entrance of the converge portion of the two diversion waterways 16, 18 faced to the water diversion passages 20, 22 is concaved for example an arc groove, the second diversion waterways 18 are arranged in a smooth curve laterally, further improving the turbulent flowing and enhancing the swirl. Above mentioned smooth transition of the inlet waterway and the second diversion waterway, the second diversion waterway and the concaved structure at the entrance of the of the converge portion of the two diversion waterways 16, 18 faced to the water diversion passages 20, 22 form a reverse S shape. Water of the first diversion waterway and the second diversion waterway impacts and speeds up to enter the water diversion passage.

The two water diversion passages 20, 22 are axially symmetrically arranged, the outlet opening of the two water diversion passages 20, 22 are faced to each other, the flowing direction of the outlet of the water diversion passages 20, 22 intersect, therein, the two water diversion passages 20, 22 are arranged smoothly, for example, in an arc, and the two water diversion passages 20, 22 form a splayed structure with the opening faced upwardly. The smooth arrangement increases the swirl effect of water after the impacting, thus increasing the turbulent flowing.

In detailed, the splash water outlet mechanism comprises a diverter shell 26 and a diverter 28. The diverter shell 26 is hollow with a hollow hole penetrating through the diverter shell 26, the diverter 28 is relatively fixedly assembled in the diverter shell 26, the relative fixed connection is configured for example: the hollow hole 261 of the diverter shell 26 is disposed with a step hole with a step surface face upwardly, the diverter 28 is positioned on the step surface for positioning, the outlet mechanism is assembled in the main body of the shower head and is fixed in the main body by the main body structure. The diverter 28 is disposed with above mentioned outlet 14, the inlet waterway 24, the second diversion waterway 18, the lateral portion 162 and the water diversion passages 20, 22, the inlet of the lateral portion 162 is disposed in the outer wall of the diverter 28, a gap or notch is defined between the inner wall of the diverter shell 26 and the outer wall of the diverter 28, the gap or notch forms above mentioned longitudinal portion 161; the outlet is connected to the lower portion of the hollow hole, the diameter of the lower portion of the hollow hole is greatly larger than the diameter of the outlet. The splash water outlet mechanism is simple and compact, the manufacturing costs low, the molding costs low, the assembly is convenient and fast.

In detailed, the diverter 28 comprises a main body portion 30 and a coupling portion 32, the first coupling surface of the main body portion 30 is concaved with groove portions 34 corresponding to above mentioned outlet 14, the inlet waterway 24, the second diversion waterway 18, the lateral portion 162 and the water diversion passages 20, 22, the second coupling surface of the coupling portion 32 and the first coupling surface of the main body portion 30 are fixedly connected to each other face to face in sealing way, the fixed connection is realized by the diverter assembled into the diverter shell, the sealing connection makes the concave portions 34 form above mentioned outlet 14, the inlet waterway 24, the second diversion waterway 18, the lateral portion 162 and the water diversion passages 20, 22. The splash water outlet mechanism is simple and compact, the manufacturing costs low, the molding costs low, the assembly is convenient and fast.

In this embodiment, the portion of the main body portion 30 faced to the inlet direction of the inlet waterway is arranged curve with opening face upwardly, the portion of the main body portion 30 faced to the outlet direction of the outlet is arranged curve with opening face downwardly, for example an arc groove, the turbulent flowing is increased, forming wavy water type spraying out of the outlet, and forming oscillating splash water.

To position the main body portion and the coupling portion conveniently, the main body portion is disposed with at least two protruding columns 301, the coupling portion is concaved with at least two insert holes 321, the protruding columns are inserted into the insert holes in coupling way.

Figure 9:
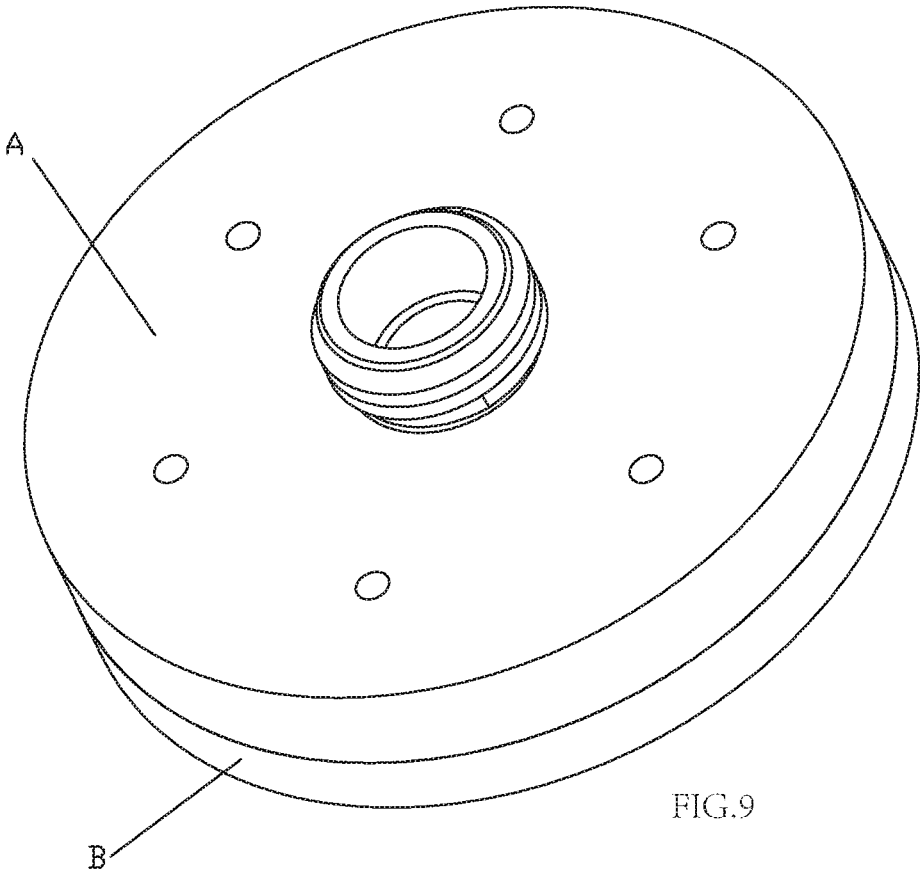
FIG. 9 illustrates a schematic diagram of the splash water outlet mechanism applied in a shower head.
Figure 10:
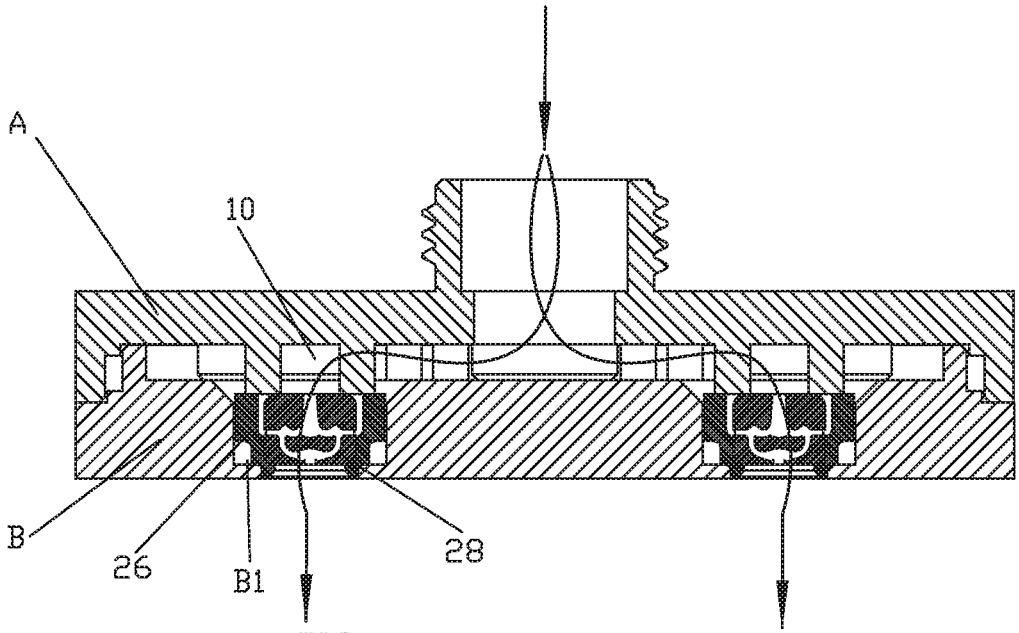
FIG. 10 illustrates a sectional diagram of the splash water outlet mechanism applied in the shower head.
Figure 11:
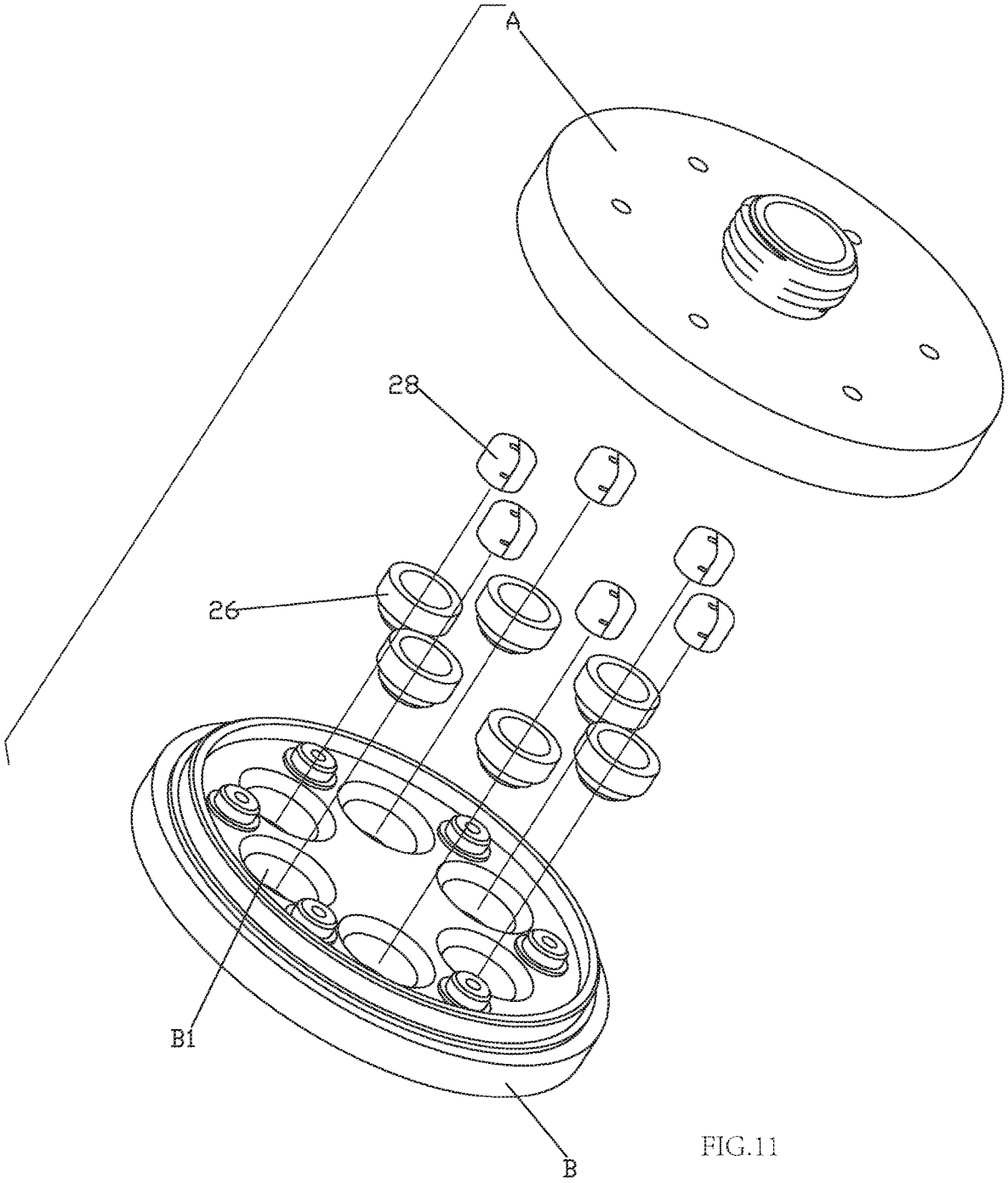
FIG. 11 illustrates an exploded and schematic diagram of the splash water outlet mechanism applied in the shower head.
Figure 12:
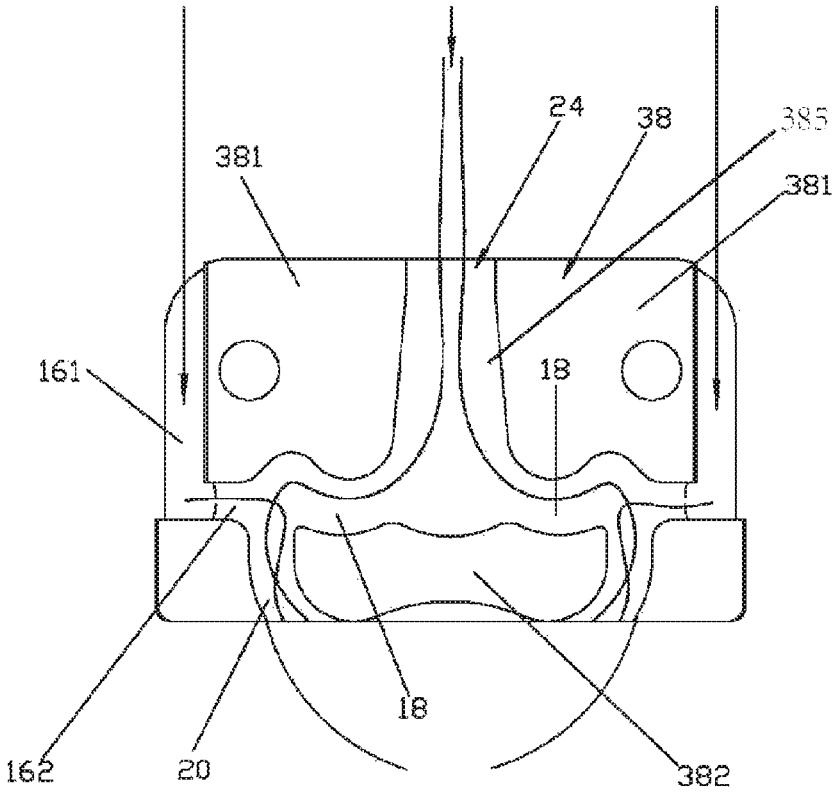
FIG. 12 illustrates a back view of an accessory portion of a second embodiment.
Figure 13:
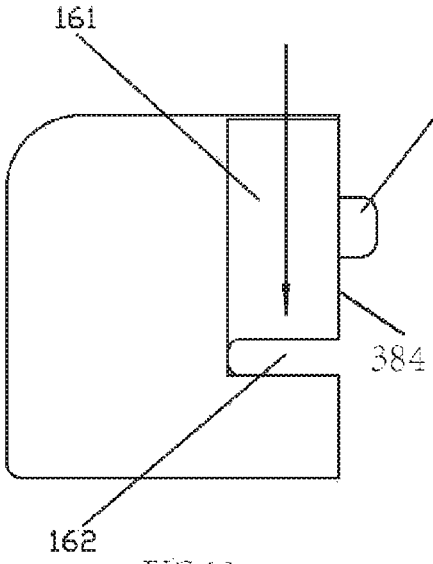
FIG. 13 illustrates a right view of the accessory portion of the second embodiment.
Figure 14:
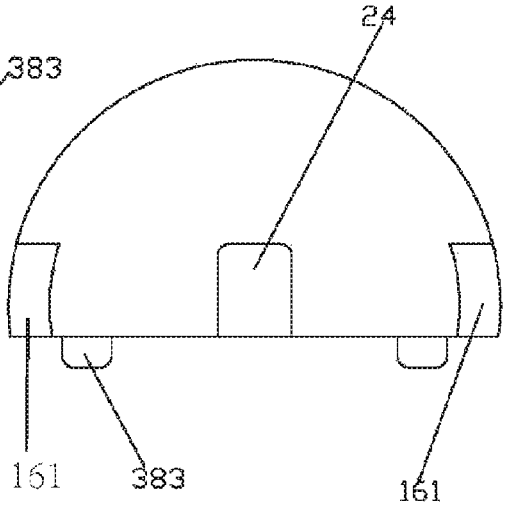
FIG. 14 illustrates a top view of the accessory portion of the second embodiment.
Figure 15:
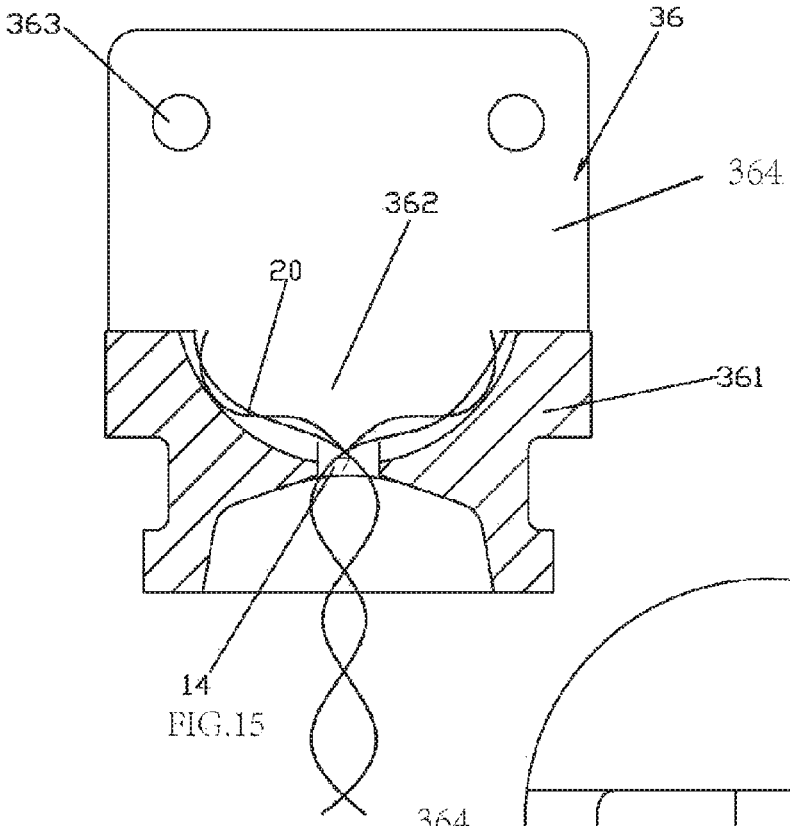
FIG. 15 illustrates a front view of the base of the second portion with partial section.
Figure 17:
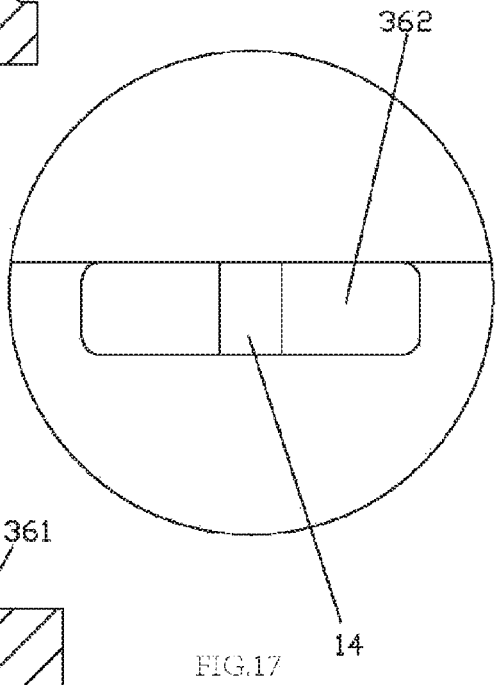
FIG. 17 illustrates a partial top view of the base of the second embodiment.
Figure 16:
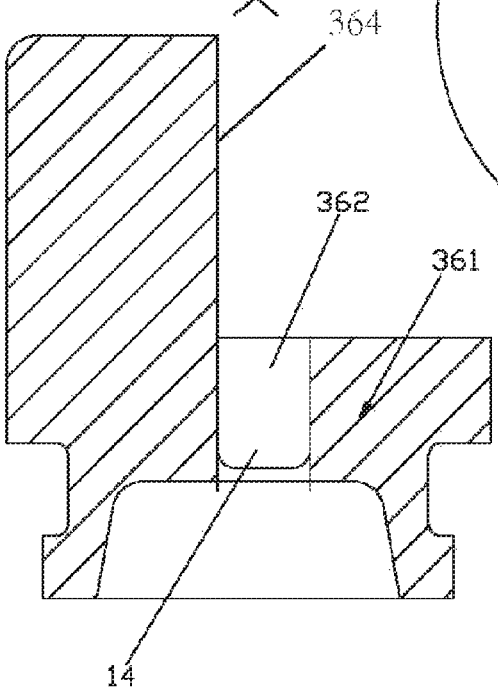
FIG. 16 illustrates a sectional diagram of the base of the second embodiment.

Referring to FIGS. 9-11, the splash water outlet mechanism is applied in a shower head, the shower head comprises a top cover A and a bottom cover B, the bottom cover B is disposed with outlet nozzles B1 passing through the bottom cover up and down, the splash water outlet mechanism is fixedly assembled into the outlet nozzle B1, in detailed, the outlet nozzle B1 is disposed with step surface face upward, the splash water outlet mechanism is positioned on the step surface, the top cover A is fixedly connected to the bottom cover B in sealing way, the top cover A is contacted on the splash water outlet mechanism to fixedly assemble the top cover A, the bottom cover B and the splash water outlet mechanism, so as to fix the diverter shell 26 and the diverter 28. The inlet passage of the shower head is the water source 10 of the splash water outlet mechanism, for the shower head, the inlet passage is connected to a forestage water source, like a water pipe fixed to the wall.

Embodiment 2

Referring to FIGS. 12-17, this embodiment differs from the first embodiment in that: the diverter 28 comprises a base 36 and an accessory portion 38.

The base 36 is disposed with a first coupling surface, the lower portion of the first coupling surface is protruding with a protruding portion 361, the top surface of which is concaved with a first groove 362; the first groove 362 is connected to the bottom surface of the protruding portion, the lower portion of the first groove forms above mentioned outlet 14.

The accessory portion 38 is disposed with a joining surface, which is convex with two first protrusions 381 and a second protrusion 382, the end face of the first protrusions and the second protrusion are the second coupling surface; the two first protrusions 381 are arranged symmetrically left and right with space, the space between the two first protrusions 381 defines the second groove corresponding to the inlet waterway, that is to say, the second groove is disposed in the second coupling surface. The two second protrusions 382 are disposed below the two first protrusions, the second protrusion 382 and the first protrusions are arranged with space, a third groove corresponding to the second diversion waterway is defined between the second protrusion 382 and the first protrusion, that is to say, the second coupling surface is disposed with the third groove. The joining surface has portions extending out of the left and right side of the first protrusion, the portions form the notch.

The accessory portion 38 is fixedly connected to the base 36, the accessory portion 38 is disposed above the protruding portion of the base 36, the second coupling surface of the accessory portion 38 is coupled to the first coupling surface of the base 36, and the second groove 385 forms above mentioned inlet waterway 24, the third groove forms the second diversion waterway; the second protrusion is disposed in the first groove, between the joining surface and the second coupling surface, that is to say, the first notch forms the longitudinal portion; the lateral portion is formed between the first protrusion 381 and the protruding portion 361; the water diversion passages are formed between the joining surface and the second coupling surface, the groove wall of the first groove and the second protrusion.

The splash water outlet mechanism is simple and compact, the manufacturing costs low, the molding costs low, the assembly is convenient and fast. To position the base 36 and the accessory portion 38 conveniently, the accessory portion 38 is disposed with at least to protruding columns 383, the base 36 is concaved with at least two insert holes 363, the protruding columns are inserted to the insert holes in coupling way.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A splash water outlet mechanism, comprising:

at least two diversion waterway sets connected to a water source, wherein each of the at least two diversion waterway sets comprises a first diversion waterway and a second diversion waterway, at least two water diversion passages, and a diverter shell and a diverter, wherein:

each of the first diversion waterways comprises a longitudinal portion connected to the water source and a lateral portion connected to the longitudinal portion, each of the second diversion waterways is connected to the water source and comprises a lateral portion, a first intersection of a flowing direction of the lateral portion of each of the first diversion waterways and a flowing direction of a corresponding one of the lateral portions of the second diversion waterways is above a lowest position of an exit of the corresponding one of the lateral portions of the second diversion waterways, each of the at least two diversion waterway sets is in correspondence with a corresponding one of the at least two water diversion passages, water from the lateral portion of each of the first diversion waterways and the corresponding one of the lateral portions of the second diversion waterways impacts and converges and then enters the corresponding one of the at least two water diversion passages, a flowing direction of the at least two water diversion passages intersect, water from the at least two water diversion passages impacts and then sprays out of an outlet, the diverter shell is hollow throughout, the diverter is fixedly disposed in the diverter shell, the diverter is disposed with the outlet, the first diversion waterways, the second diversion waterways and the at least two water diversion passages, an entrance of the lateral portion of one of the first diversion waterways is disposed at an outer wall of the diverter, and a gap or a notch is disposed between an inner wall of the diverter shell and the outer wall of the diverter, the gap or the notch forming the longitudinal portion of the one of the first diversion waterways.

2. The splash water outlet mechanism according to claim 1, wherein:

each of the second diversion waterways is arranged in a smooth curve.

3. The splash water outlet mechanism according to claim 1, further comprising:

an inlet waterway connected to each of the second diversion waterways, wherein:

a connecting intersection of the inlet waterway that connects to the lateral portion of each of the second diversion waterways forms a smooth transition.

4. The splash water outlet mechanism according to claim 1, wherein:

at a location where the lateral portion of each of the first diversion waterways converges with the corresponding one of the lateral portions of the second diversion waterways, a portion of an inner sidewall of the splash water outlet mechanism facing an entrance of the corresponding one of the at least two water diversion passages is concave.

5. The splash water outlet mechanism according to claim 1, wherein:

the at least two water diversion passages are axially symmetrically arranged, an outlet opening of a first water diversion passage of each of the at least two water diversion passages faces an outlet opening of a second water diversion passage of a corresponding one of the at least two water diversion passages, and a flowing direction of the first water diversion passage intersects a flowing direction of the second water diversion passage.

6. The splash water outlet mechanism according to claim 5, wherein:

the at least two water diversion passages are shaped as a splayed structure, and an entrance of each of the at least two water diversion passages faces upward.

7. The splash water outlet mechanism according to claim 1, wherein:

a portion of the diverter facing the longitudinal portion of the one of the first diversion waterways has a concave portion.

8. The splash water outlet mechanism according to claim 1, wherein:

the diverter comprises a main body portion and a coupling portion, a coupling surface of the main body portion is concaved to define the outlet, each of the first diversion waterways each of the second diversion waterways and a groove portion of the at least two water diversion passages, and a coupling surface of the coupling portion is fixedly connected to the coupling surface of the main body portion to form a sealing connection, the sealing connection defining the groove portion to form the outlet, each of the first diversion waterways, each of the second diversion waterways and the at least two water diversion passages.

9. The splash water outlet mechanism according to claim 1, wherein:

the diverter comprises a base and an accessory portion, the base has a coupling surface, a lower portion of the coupling surface of the base has a protruding portion, a top surface of the protruding portion is concaved to define a first groove, the first groove is connected to a bottom surface of the protruding portion, a lower portion of the first groove forms the outlet, the accessory portion has a coupling surface, the coupling surface of the accessory portion is concaved to define a second groove, the accessory portion is fixedly connected to the base, the accessory portion is disposed above the protruding portion of the base, the coupling surface of the accessory portion is coupled to the coupling surface of the base, the second groove forms one of the second diversion waterways, the accessory portion and the protruding portion are arranged to form the lateral portion of one of the first diversion waterways, and the accessory portion and a groove wall of the first groove are arranged to form the at least two water diversion passages.

10. The splash water outlet mechanism according to claim 1, wherein:

an obstacle is defined by the second diversion waterways and the at least two water diversion passages, and in a cross-sectional view, a surface of the obstacle facing an inlet waterway through which the second diversion waterways are connected to the water source is concave.

11. The splash water outlet mechanism according to claim 1, further comprising:

an inlet waterway through which the lateral portions of the second diversion waterways are connected to the water source.

12. The splash water outlet mechanism according to claim 11, wherein:

the inlet waterway intersects the lateral portions of the second diversion waterways, and a flowing direction of the inlet water is perpendicular to flowing directions of the lateral portions of the second diversion waterways at a second intersection of the inlet waterway and the lateral portions of the second diversion waterways.

* * * * *